US006979818B2

(12) United States Patent
Scheidemann et al.

(10) Patent No.: US 6,979,818 B2
(45) Date of Patent: Dec. 27, 2005

(54) MASS SPECTROMETER FOR BOTH POSITIVE AND NEGATIVE PARTICLE DETECTION

(75) Inventors: Adi A. Scheidemann, Baden (CH); Mark W. Dassel, Indianola, WA (US); Mark Wadsworth, Sierra Madre, CA (US); Eustathios Vassiliou, Newark, DE (US)

(73) Assignee: OI Corporation, College Station, TX (US)

( * ) Notice: Subject to any disclaimer, the term of this patent is extended or adjusted under 35 U.S.C. 154(b) by 0 days.

(21) Appl. No.: 10/860,776

(22) Filed: Jun. 3, 2004

(65) Prior Publication Data

US 2005/0017166 A1 Jan. 27, 2005

Related U.S. Application Data

(60) Provisional application No. 60/484,801, filed on Jul. 3, 2003.

(51) Int. Cl.[7] ..... H01J 37/244

(52) U.S. Cl. ..... 250/299; 250/283; 250/397; 250/396 ML

(58) Field of Search ..... 250/299, 283, 250/297, 396 ML

(56) References Cited

U.S. PATENT DOCUMENTS

| | | | | |
|---|---|---|---|---|
| 3,898,456 | A | 8/1975 | Dietz | 250/299 |
| 4,988,867 | A | 1/1991 | Laprade | 250/281 |
| 5,317,151 | A | 5/1994 | Sinha et al. | 250/298 |
| 5,801,380 | A | 9/1998 | Sinha | 250/299 |
| 6,046,451 | A | 4/2000 | Sinha | 250/298 |
| 6,180,942 | B1 * | 1/2001 | Tracy et al. | 250/299 |
| 6,182,831 | B1 | 2/2001 | Scheidemann et al. | 209/213 |
| 6,191,419 | B1 | 2/2001 | Sinha | 250/294 |
| 6,403,956 | B1 | 6/2002 | Sinha | 250/298 |
| 6,576,899 | B2 | 6/2003 | Sinha et al. | 250/299 |

(Continued)

FOREIGN PATENT DOCUMENTS

| | | |
|---|---|---|
| GB | 650861 | 3/1951 |

OTHER PUBLICATIONS

J. Mattauch, Ergebnisse der exakten Naturwissenschaften, vol. 19, p. 170-236, 1940.

(Continued)

*Primary Examiner*—Kiet T. Nguyen
(74) *Attorney, Agent, or Firm*—Seed IP Law Group PLLC

(57) ABSTRACT

A mass spectrometer suitable to measure both positive and negative particles, such as ions for example in a vacuum chamber. This spectrometer is provided with a turnable permanent magnet segment, which provides the gap of a yoke with adequate magnetic flux having the appropriate direction to separate the positive or the negative particles. Changing the polarity adjusts the flight path of the ions. Thus, negatively charged ions and positively charged ions will follow similar flight paths under opposite polarities, permitting the use of a single array of detectors. One or more coils may be used in place of or in addition to the turnable permanent magnet segment in order to provide the appropriate magnetic flux to the gap, and/or facilitate the turning process of the turnable magnet segment. The turnable magnet and/or the coils may be inside or outside the vacuum chamber. The detector may comprise at least one detector area, two charge mode amplifiers coupled to the detector area, a first CCD shift register coupled to a first one of the charge mode amplifiers and a second CCD shift register coupled to a second one of the charge mode amplifiers.

8 Claims, 10 Drawing Sheets

U.S. PATENT DOCUMENTS

2002/0117617 A1 8/2002 Sinha et al. ..... 250/299

OTHER PUBLICATIONS

Robert B. Darling, Adi A. Scheidemann, K. N. Bhat, and T.-C. Chen, Micromachined Faraday Cup Array Using Deep Reactive Ion Etching, Sensors and Actuators, A95 (2002) 84-93.

R. B. Darling, A. A. Scheidemann, K. N. Bhat, and T.-C. Chen,, Proc. of the 14th IEEE Int. Conf. on Micro Electro Mechanical Systems (MEMS-2001), Interlaken, Switzerland, Jan. 21-25, 2001, pp. 90-93.

Nier, D. J. Schlutter Rev. Sci. Instrum. 56(2), p. 214-219, 1985.

T. W. Burgoyne et. al. J. Am. Soc. Mass Spectrum 8, p. 307-318, 1997.

Scheidemann et al., "Faraday Cup Detector Array with Electronic Multiplexing for Multichannel Mass Spectrometry," *J. Vac. Sci. Technol., A 20*(3):597-607, 2002.

* cited by examiner

MASS SPECTROMETER FOR BOTH POSITIVE AND NEGATIVE PARTICLE DETECTION

RELATED APPLICATIONS

This application claims the benefit of provisional patent application No. 60/484,801, filed on Jul. 3, 2003, which is incorporated herein by reference in its entirety.

FIELD OF THE INVENTION

This invention pertains switchable magnetic sections, double focusing sections of mass spectrometers comprising such switchable magnetic sections, and more particularly mass spectrometers for both positive and negative particle detection. In addition, this invention pertains instruments comprising mass spectrometers with the aforementioned switchable magnetic sections, such as for example combinations of the mass spectrometers of the instant invention with other spectrometers, chromatographs, or any other particular instrument(s).

BACKGROUND OF THE INVENTION

Mass spectrometry is widely used in many applications ranging from process monitoring to life sciences. Over the course of the last 60 years, a wide variety of instruments have been developed. The focus of new developments has been two fold: (1) a push for ever higher mass range with high mass resolution and MS/MS capability, and (2) on developing small, desktop MS instruments.

Mass spectrometers are often coupled with gas chromatographs (GC/MS) for analysis of complex mixtures. This is especially the case for volatile compound (VOC) and semi-volatile compound (semi-VOC) analysis. A GC/MS instrument typically has a gas inlet system (the GC would be part of this), an electron impact based ionizer [EI] with ion extractor, some optic elements to focus the ion beam, ion separation, and ion detection. Ionization can also be carried out via chemical ionization.

Ion separation can be performed in the time or spatial domain. An example for mass separation in the time domain is a time of flight mass spectrometer. Time domain separation is seen in commonly used quadrupole mass spectrometers. Here the "quadrupole filter" allows only one mass/charge ratio to be transmitted from the ionizer to the detector. A full mass spectrum is recorded by scanning the mass range through the "mass filter". Other time domain separation is based on magnetic fields where either the ion energy or the magnetic field strength is varied, again the mass filter allowing only one mass/charge ratio to be transmitted and a spectrum can be recorded through scanning through the mass range.

An alternative concept is a mass spectrograph in which the ions are spatially separated in a magnetic field and detected with a position sensitive detector. The concept of a double focusing mass spectrograph was first introduced by Mattauch and Herzog (MH) in 1940 (J. Mattauch, Ergebnisse der exakten Naturwissenschaften, vol 19, page 170–236, 1940, which is incorporated herein by reference in its entirety).

Double focusing refers to the instrument's ability to refocus both the energy spread as well as the spatial beam spread. Modern developments in magnet and micro machining technologies allow dramatic reductions in the size of these instruments. The length of the focal plane in a mass spectrometer capable of VOC and semi-VOC analysis is reduced to a few centimeters.

The typical specifications of a small confocal plane layout Mattauch-Herzog instrument are summarized below:

- Electron impact ionization, Rhenium filament
- DC-voltages and permanent magnet
- Ion Energy: 0.5–2.5 kV DC
- Mass Range: 2–200 D
- Faraday cup detector array or strip charge detector or electro optical ion detector
- Integrating operational amplifier with up to $10^{11}$ gain
- Duty Cycle: >99%
- Read-Out time: 0.03 sec to 10 sec
- Sensitivity: approximately 10 ppm with strip charge detector In traditional instruments the ion optic elements are mounted in the vacuum chamber floor or on chamber walls. The optics can also be an integral part of the vacuum housing lay-out. In small instruments, however, the ion optics can easily be built on a base plate which acts as an "optical bench". This bench holds all components of the ion optics. The base plate is mounted against a vacuum flange to provide the vacuum seal needed to operate the mass spectrometer under vacuum. The base plate can also be the vacuum flange itself.

The ion detector in a Mattauch-Herzog layout is a position sensitive detector. Numerous concepts have been developed over the last decades. Recent developments focus on, solid state based direct ion detection as an alternative to previously used electro optical ion detection (EOID).

The electro optical ion detector (EOID) converts the ions in a multi-channel-plate (MCP) into electrons, amplifies the electrons (in the same MCP), and illuminates a phosphorus film with the electrons (emitted from the MCP). The image formed on phosphorus film is recorded with a photo diode array via a fiber optic coupler (see U.S. Pat. No. 5,801,380, which is incorporated herein by reference in its entirety). The electro-optic ion detector (EOID), is intended for the simultaneous measurement of ions spatially separated along the focal plane of the mass spectrometer. This device may operate by converting ions to electrons and then to photons. The photons form images of the ion-induced signals. The ions generate electrons by impinging on a microchannel electron multiplier array. The electrons are accelerated to a phosphor-coated fiber-optic plate that generates photon images. These images are detected using a photodetector array. The electro-optic ion detector (EOID), although highly advantageous in many ways, is relatively complicated since it requires multiple conversions. In addition, there may be complications from the necessary use of phosphors, in that they may limit the dynamic range of the detector. A microchannel device may also be complicated, since it may require high-voltage, for example 1 KV, to be applied. This may also require certain of the structures such as a microchannel device, to be placed in a vacuum environment such as 106 Torr. At these higher pressures of operation, the microchannel device may experience ion feedback and electric discharge. Fringe magnetic fields may affect the electron trajectory. Isotropic phosphorescence emission may also affect the resolution. The resolution of the mass analyzer may be therefore compromised due to these and other effects.

According to a different configuration, a direct charge measurement can be based on a micro-machined Faraday cup detector array. Here, an array of individually addressable Faraday cups monitors the ion beam. The charge collected in individual elements of the array is handed over to an amplifier via a multiplexer unit. This layout reduces the number of amplifiers and feedthroughs needed. This concept is described in detail in recent publications, such as "A. A. Scheidemann, R. B. Darling, F. J. Schumacher, and A. Isakarov, Tech. Digest of the 14th Int. Forum on Process Analytical Chem. (IFPAC-2000), Lake Las Vegas, Nev., Jan. 23–26, 2000, abstract I-067"; "R. B. Darling, A. A. Scheidemann, K. N. Bhat, and T.-C. Chen, Proc. of the 14th IEEE Int. Conf. on Micro Electro Mechanical Systems (MEMS-2001), Interlaken, Switzerland, Jan. 21–25, 2001, pp. 90–93"; and Non-Provisional patent application Ser. No. 09/744,360 titled "Charged Particle Beam Detection System"; all three of which are incorporated herein by reference in their entirety.

Other important references regarding spectrometers are "Nier, D. J. Schlutter Rev. Sci. Instrum. 56(2), page 214–219, 1985; and T. W. Burgoyne et. al. J. Am. Soc. Mass Spectrum 8, page 307–318, 1997; both of which are incorporated herein by reference in their entirety.

Alternatively, especially for low energy ions, a flat metallic strip (referred to as a strip charge detector (SCD)) on a grounded and insulated background can be used to monitor the ion beam. Again the charge is handed over to an amplifier via a multiplexer.

A very important ion detector array is disclosed in U.S. Pat. No. 6,576,899, which is also incorporated herein by reference in its entirety. It may be referred to as a shift register based direct ion detector.

That application defines a charge sensing system which may be used, for example, in a Mass Spectrometer system, e.g. a Gas chromatography—Mass spectrometry (GC/MS) system, with a modified system which allows direct measurement of ions in a mass spectrometer device, without conversion to electrons and photons (e.g., EOID) prior to measurement. In one case, it may use charge coupled device (CCD) technology. This CCD technology may include metal oxide semiconductors. The system may use direct detection and collection of the charged particles using the detector. The detected charged particles form the equivalent of an image charge that directly accumulates in a shift register associated with a part of the CCD. This signal charge can be clocked through the CCD in a conventional way, to a single output amplifier. Since the CCD uses only one charge-to-voltage conversion amplifier for the entire detector, signal gains and offset variation of individual elements in the detector array may be minimized.

In a Mattauch-Herzog layout the detector array, composed of either Faraday cup detector array or strip charge detector, or any other type of the aforementioned detectors, has to be placed at the exit of the magnet. This position is commonly referred to as the "focal plane".

The Faraday cup detector array (FCDA) can be made by deep reactive ion etching (DRIE). The strip charge detector (SCD) can be made by vapor deposition. The dice with the active element (FCDA or SCD) is usually cut out of the wafer with conventional techniques such as laser cutting or sawing.

The FCDA or SCD dice needs to be held in front of the magnet and electronically connected to the multiplexer and amplifier unit called "Faraday Cup Detector Array"—"Input/Output"—"Printed Circuit Board" (FCDA-I/O-PCB) to read out the charge collected with the detector elements.

In traditional Mattauch-Herzog instruments the ion optics are placed on the vacuum chamber wall, and the position sensitive ion detector is mounted on the exit flange of the ion flight path. This arrangement is required as a result of having the magnet outside of the vacuum. The multiplexer and amplifier unit is also positioned outside of the vacuum chamber in the case of traditional Mattauch-Herzog instruments.

According to the present invention it is highly preferable that all parts of the ion optics are placed on the "base plate", thus the position sensitive solid state based ion detector may be mounted against the same base plate. However, in certain embodiments of this invention, part of the magnetic section may be under vacuum, and part under atmospheric pressure. Further, the multiplexer and amplifier unit may also be positioned inside the vacuum chamber, which presents many advantages.

In general, the particles detected, usually ions, may be either negative or positive. A certain class of instruments has been used so far to detect positive particles, and a different class of instruments has been used to detect negative particles According to the present invention a single instrument is being used to detect and measure both positive and negative particles.

SUMMARY OF THE INVENTION

As aforementioned, this invention pertains switchable magnetic sections, double focusing sections of mass spectrometers comprising such switchable magnetic sections, and more particularly mass spectrometers for both positive and negative particle detection. In addition, this invention pertains instruments comprising mass spectrometers with the aforementioned switchable magnetic sections, such as for example combinations of the mass spectrometers of the instant invention with other spectrometers, chromatographs, or any other particular instrument(s).

More particularly, this invention pertains switchable magnetic section of a mass spectrometer comprising:

an upper yoke segment;

a lower yoke segment opposite the upper yoke segment; and a turnable permanent magnet segment, having a north pole and a south pole, disposed between the upper yoke segment and the lower yoke segment in a manner that there is a magnet/yoke gap between each pole and each respective yoke segment;

wherein the upper yoke segment and the lower yoke segment further provide a magnetic gap or return flux, within which, ions of different masses follow different paths.

The magnet/yolk gap may be preferably substantially zero during operation of the spectrometer, and greater than zero during an operation involving turning of the turnable permanent magnet segment.

The magnetic yoke segment may also comprise a coil.

The upper yoke segment may be supported on a first slider, the first slider being operable to slide on a first column by a first piston. Further, the turnable magnet segment may be supported on a second slider, the second slider being operable to slide on a second column by a second piston.

The present invention further pertains a mass spectrometer, comprising:

a vacuum chamber;

an ion source disposed in the vacuum chamber;

a magnetic assembly operable to selectively produce a magnetic field in the vacuum chamber of a first orientation at a first time, and a second orientation at a second time; and an ion detector comprising at least one detector area, at least two charge mode amplifiers coupled to the detector area, at least two CCD shift registers, a first one of the CCD shift registers coupled to a first one of the charge mode amplifiers and a second one of the CCD shift registers coupled to a second one of the charge mode amplifiers.

The strip charge collectors in the present invention are preferably connected to a reset line system according to the teaching in U.S. Pat. No. 6,576,899B2. Before each new measurement, this system is used to drain the accumulated charge from the previous measurement out of the strip charge detectors. Thus, the strip charge detectors are set to a given desired potential prior to each new measurement.

The mass spectrometer may further comprise:

a set of transfer optics received in the vacuum chamber between the ion source and the ion detector; and an electro static sector analyzer received in the vacuum chamber between the ion source and the ion detector.

The magnetic assembly of the mass spectrometer may comprise a permanent magnet mounted for rotation with respect to the vacuum chamber. The magnetic assembly may also comprise a permanent magnet and a yoke or flux return, which magnet may be positioned within the vacuum chamber for rotation with respect thereto. The magnetic assembly may also comprise a permanent magnet mounted outside the vacuum chamber for rotation with respect thereto. The magnetic gap or flux return may be at least partially mounted within the vacuum chamber.

The magnetic assembly may comprise a coil wrapped around yoke or flux return, a current source, and at least one switch selectively operable to cause a current to flow from the current source through the coil in a first direction at a first time and in a second direction at a second time.

This invention also pertains a method of operating a mass spectrometer, the method comprising:

operating a magnet to produce a magnetic field having a first orientation in a vacuum chamber during a first period;

injecting ions of a first charge into the magnetic field within the vacuum chamber during the first period;

receiving the ions of the first charge at a first detector area during the first period;

operating the magnet to produce a magnetic field having a second orientation in the vacuum chamber during a second period;

injecting ions of a second charge into the magnetic field within the vacuum chamber during the second period; and receiving the ions of the second charge at the first detector area during a second period.

The method may further comprise steps of:

providing signals from the first detector area to a first charge mode amplifier during the first period; and providing signals from the first detector area to a second charge mode amplifier during the second period.

In addition, the method may further comprise steps of:

providing signals from the first charge mode amplifier to a first CCD shift register during the first period; and providing signals from the second charge mode amplifier to a second CCD shift register during the second period.

The step of operating a magnet to produce a magnetic field having a second orientation in a vacuum chamber during a second period may comprise a step of rotating a permanent magnet from a first position to a second position.

Also, the step of operating a magnet to produce a magnetic field having a first orientation in a vacuum chamber during a first period may comprise a step of rotating a permanent magnet into a first position and the step of operating the magnet to produce a magnetic field having a second orientation in the vacuum chamber during a second period may comprise a step of rotating the permanent magnet to a second position from the first position.

The step of operating a magnet to produce a magnetic field having a second orientation in a vacuum chamber during a second period may comprise a step of switching a direction of a current passing through a coil from a first direction to a second direction.

The step of operating a magnet to produce a magnetic field having a first orientation in a vacuum chamber during a first period may comprise a step of supplying current through a coil in a first direction and the step of operating the magnet to produce a magnetic field having a second orientation in the vacuum chamber during a second period may comprise a step of changing the direction of current flow in the coil to a second direction from the first direction.

The present invention is further related to a method of operating a magnetic section of a mass spectrometer, the magnetic section comprising an upper yoke segment, a lower yoke segment, and a turnable permanent magnet segment having a north pole and a south pole, the turnable permanent magnet being disposed between the upper yoke segment and the lower yoke segment in the vicinity of one side of said segments, the segments further having a magnetic gap in an opposite side of said segments, the method comprising steps of:

directing the north pole toward the upper yoke segment, and the south pole toward the lower yoke segment to assume a first stable position, when it is desirable to influence the path of ions having a first polarity within the magnetic gap; and directing the north pole toward the lower yoke segment, and the south pole toward the upper yoke segment to assume a second stable position, when it is desirable to influence the path of ions having a second polarity within the magnetic gap, the first polarity being substantially opposite to the first polarity.

The method may further comprise a step of imposing to at least one of the upper and lower yoke segment, an electromagnetic field opposite to the field provided by the permanent magnet segment when it is desired to turn the turnable permanent magnet segment from one of the first and second stable position to a respective opposite position.

Stable positions are the ones that the turnable permanent magnet segment will assume when it is free to turn and turns by the attraction of the yoke segments.

The method may also comprise a step of bringing to substantial contact the poles of the turnable permanent magnet segment with respective yoke segments when said turnable permanent magnet segment is in the first or second stable position.

In addition, the method may further comprise a step of maintaining a distance between the poles of the turnable permanent magnet segment and respective yoke segments when said turnable permanent magnet segment is in a situation selected from being and intended to be turned away form the first or second stable position.

The present invention also pertains not only Mass Spectrometers (MS), but also combination of Mass Spectrometers with other Mass Spectrometers (e.g., MS/MS), as well as combinations of Gas Chromatographs with Mass Spectrometers (e.g., GC/MS and GC/GC/MS) comprising the turnable permanent magnet section and/or electromagnetic section of this invention. The present invention is further related to various peripherals used in combination with Mass Spectrometers including without limitation auto sampling devices and electro-spray devices.

BRIEF DESCRIPTION OF THE DRAWING

The reader's understanding of this invention will be enhanced by reference to the following detailed description taken in combination with the drawing figures, wherein.

DETAILED DESCRIPTION OF THE INVENTION

As aforementioned, this invention pertains switchable magnetic sections, double focusing sections of mass spectrometers comprising such switchable magnetic sections, and more particularly mass spectrometers for both positive and negative particle detection. In addition, this invention pertains instruments comprising mass spectrometers with the aforementioned switchable magnetic sections, such as for example combinations of the mass spectrometers of the instant invention with other spectrometers, chromatographs, or any other particular instrument(s).

Figure 1:
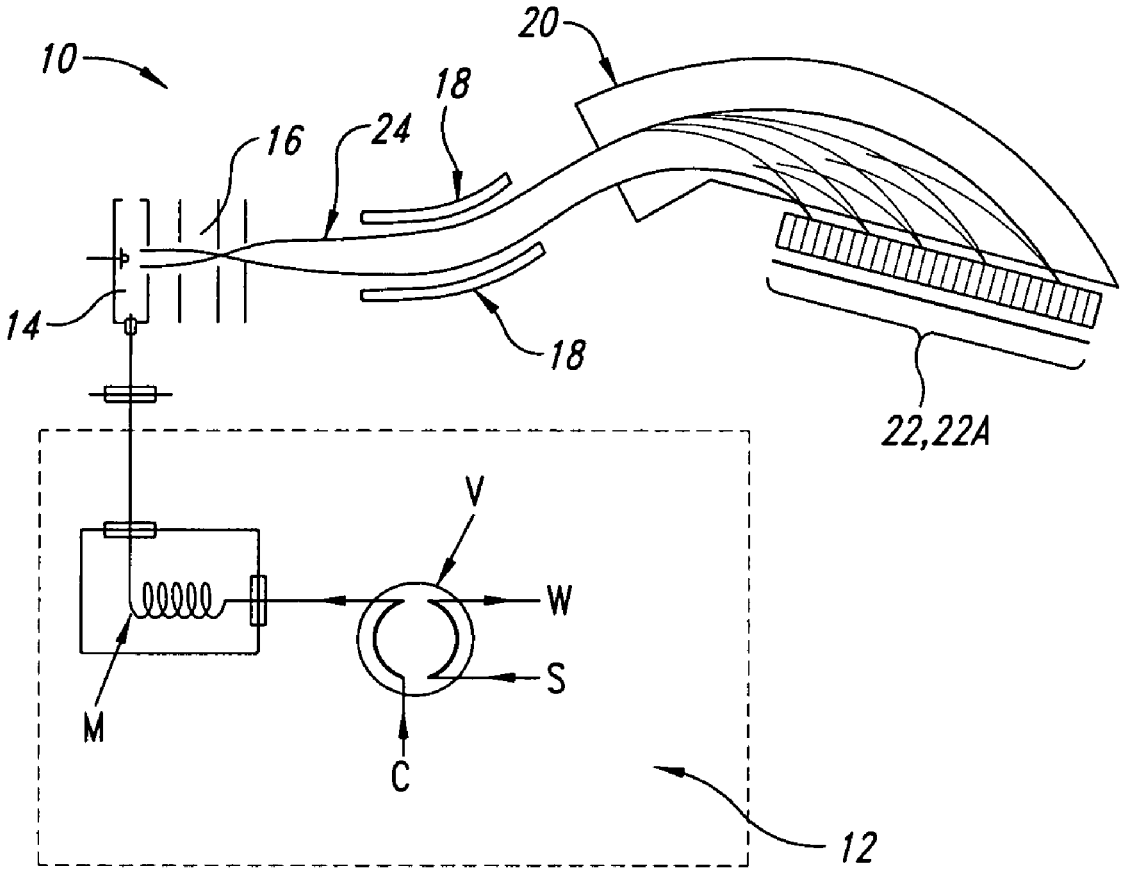
FIG. 1 illustrates a schematic view of a Mattauch Herzog spectrometer connected to a gas chromatograph.

Referring now to FIG. 1, there is depicted a schematic diagram of a double focusing mass spectrometer (Mattauch-Herzog layout) 10, along with a separate preceding unit of a gas chromatograph apparatus 12.

The double focusing mass spectrometer 10 comprises an ionizer 14, a shunt and aperture 16, an electro static energy analyzer 18, a magnetic section 20, and a focal plane section 22.

In the operation of a mass spectrometer (MS), gaseous material or vapor is introduced into the ionizer 14, either directly or through the gas chromatograph 12 (for complex mixtures or compounds), where it is bombarded by electrons, thus producing ions, which ions are focused in the shunt and aperture section 16 forming an ion beam 24. In sequence, they are rendered to have the same kinetic energy and separated according to their charge/mass ratio in the electro static energy analyzer 18, and the magnetic section 20, respectively. They are then detected in the focal plane section 22, as shown for example in FIG. 2 and as disclosed for example in U.S. Pat. No. 5,801,380, which is incorporated herein by reference. The process takes place under vacuum of the order of about $10^{-5}$ Torr with a use of a vacuum pump (not shown).

The gas chromatograph (GC) 12 illustrated in FIG. 1, in this specific example (although a liquid injector is considerably more common), comprises a sample injector valve V, which has an entry port S for introduction of the sample, an exit port W for the waste after the sample has been vaporized and/or decomposed, typically by heat, and the part to be analyzed (referred to as analyte) is carried by a carrier gas, such as dry air, hydrogen, or helium, for example, to a capillary column M (wall coated open tubular, or porous layer open tubular, or packed, etc.), where its constituents are separated by different degrees of interaction between each constituent or analytes and the stationary phase on the wall of the microbore column M, which has a rather small inside diameter, of the order of about 50–500 $\mu$m for example. The carrier gas flows typically at 0.2 to 5 atm. $cm^3$/sec, although higher flows, such as for example 20 atm. $cm^3$/sec are possible. In sequence, the miscellaneous constituents of the sample enter the ionizer for further spectrometric analysis as described above.

The larger the bore of the capillary tube the larger the vacuum pump is necessary, and the smaller the bore the narrower the peaks of the effluent resulting to a large loss of signal. In general, the gas flow is a function of the inner diameter and the length of the column, as well as the pressure of the carrier gas and the temperature. The width of the peak again is a function of the injection time, the stationary phase of the column (e.g. polarity, film thickness, distribution in the column), the width and length of the column, the temperature and the gas velocity. Thus, a compromise has to be decided. This problem has been addressed by U.S. Pat. No. 6,046,451, which is incorporated herein by reference.

The mass spectrometers of the present invention are very fast, so that even with narrow peak widths, many slices may be collected to provide good performance, even with small capillary bores and small vacuum pumps.

Other patents representing major advances in the art of mass spectrometers (MS or GS/MS) are U.S. Pat. No. 5,317,151, U.S. Pat. No. 5,801,380, U.S. Pat. No. 6,182,831 B1, U.S. Pat. No. 6,191,419 B1, U.S. Pat. No. 6,403,956 B1, and U.S. Pat. No. 6,576,899 B2, among others, all six of which are incorporated herein by reference.

Figure 2:
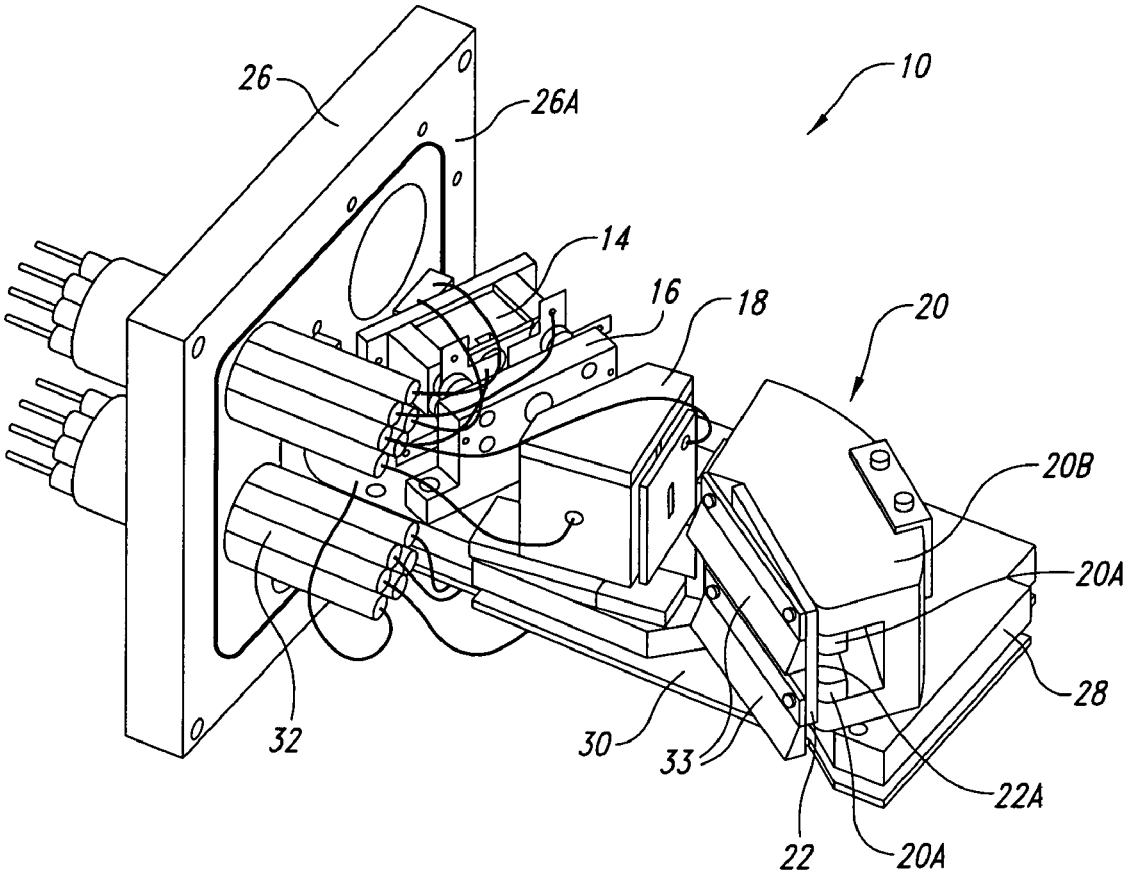
FIG. 2 is a photograph of the vacuum portion of a miniaturized Mattauch Herzog spectrometer, including a vacuum flange, base plate, an ionizer, an electro static energy analyzer, a magnetic section, and a focal plane section.
Figure 3:
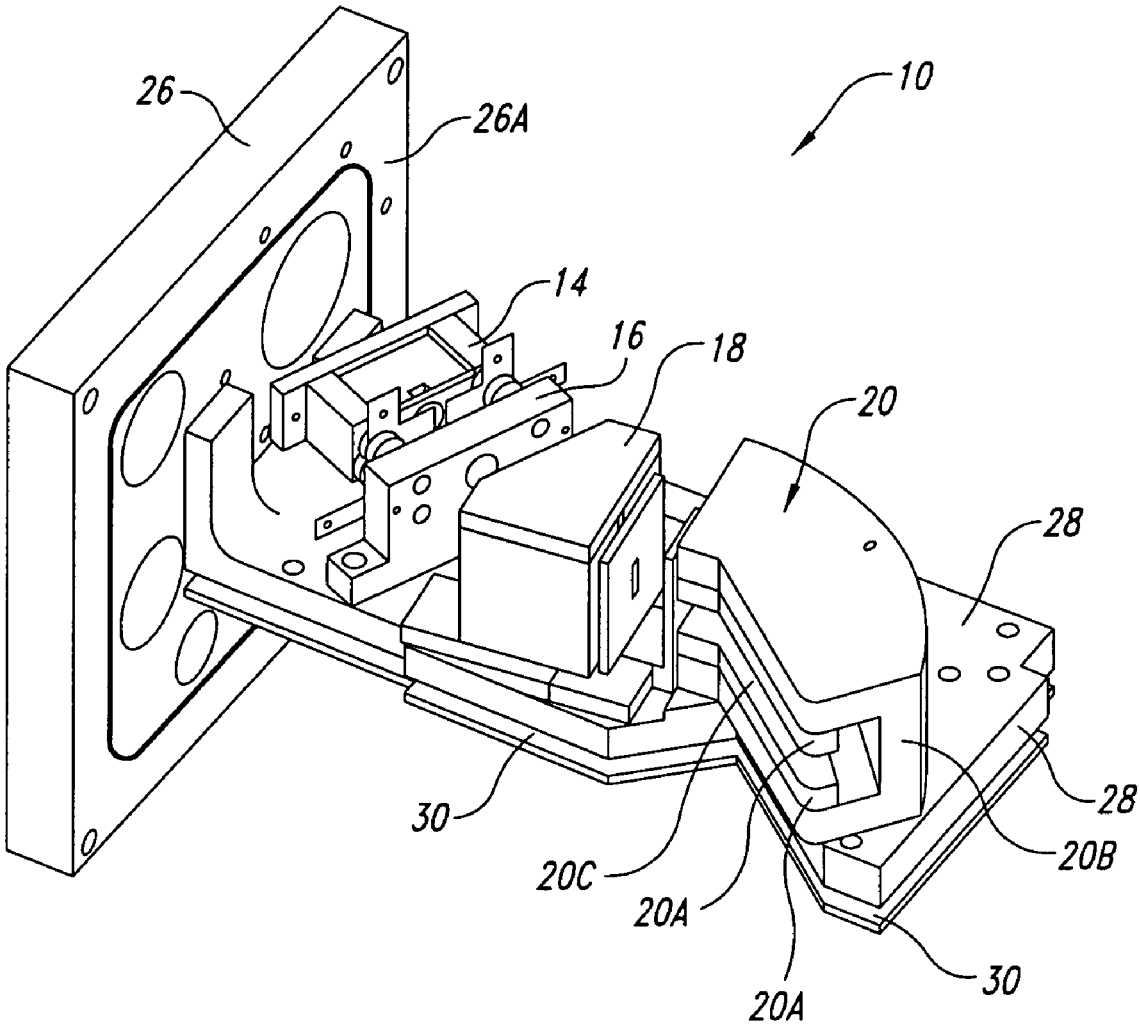
FIG. 3 illustrates a perspective view of a similar Mattauch Herzog spectrometer as in FIG. 2, including a vacuum flange, base plate, an ionizer, an electro static energy analyzer, and a magnetic section. The focal plane section is not shown for purposes of clarity.

FIG. 2 is a photograph illustrating major components or the Mattauch-Herzog Sector 10 of a miniaturized mass spectrometer, which is a highly preferable configuration according to the present invention. A base plate 28 is supported on a vacuum flange 26, on the front face 26A of which flange 26 there is secured a vacuum chamber (not shown) to cover the vacuum space within which said major components are residing.

It is important to notice that all these components are supported on the base plate 28, which results in a very sturdy and accurate configuration. In addition when you mount the components on the vacuum chamber wall, then the wall moves when vacuum is pulled due to differential pressure. Even slight movement can throw off delicate alignment. However, because the base plate in the case of the present invention is isolated from such movement and because the pressure is equal on all sides of the base plate by virtue of it being in the vacuum chamber, then the alignment is kept perfectly isolated from such negative effects.

A number of vacuum sealed input/output leads 32 are disposed on the vacuum flange 26 for communication purposes between components within the vacuum chamber (not shown) and other components outside said vacuum chamber.

An Ionizer 14 is secured on the base plate 28, close to the vacuum flange 26, with a shunt and aperture combination 16 in front of the ionizer 14. Further away from the flange 26, there is disposed an electrostatic energy analyzer 18, which is also secured on the base plate 28.

In sequence, a magnetic sector 20 is also secured on the base plate 28. The magnetic sector 20 comprises a yoke 20B and magnets 20A attached to the yoke 20B. It is highly desirable that the yoke has high magnetic flux saturation value. Therefore, a yoke 20B having a saturation value of at least 15,000 G is preferable, and more preferable is one having a saturation value of more than 20,000 G. Such yokes are made for example of hyperco-51A VNiFe alloy.

A focal plane section 22 is disposed in front of the magnetic section 20, while flexible cables 33 receive information from an ion detector 22A (not shown), supported within the focal section 22, and deliver it to a multiplexer/amplifier 30, preferably disposed under the base plate 28.

It is important to notice that all these components are supported on the base plate 28, which results in a very sturdy and accurate configuration.

Regarding the magnet design, it should be noted that the volume and mass of a magnet is typically inversely proportional to the energy product value of the magnetic material. A typical magnetic material is Alnico V which has an energy product of about 5–6 MGOe. Other materials include, but are not limited to steel, Sm—Co alloys and Nd—B—Fe alloys. Unfortunately, these alloys, and more particularly Nd—B—Fe alloys, have considerably higher sensitivity to temperature variations, and methods for temperature compensation may be necessary to avoid frequent instrument calibrations and other problems. One way to compensate for temperature variations is disclosed and claimed in U.S. Pat. No. 6,403,956 B1. However, even with that technology, better temperature compensation and control are needed for more accurate results and the need of considerably less calibrations. Such improved devices are disclosed in our provisional patent application of Adi Scheidemann, Gottfried Paul Gerhard Kibelka and Eustathios Vassiliou titled "Temperature Stabilized Double Focusing Spectrometer Section", Ser. No. 60/557,920, filed on Mar. 31, 2004, which is incorporated herein by reference in its entirety, and also in our provisional patent application of Eustathios Vassiliou and Gottfried P. G. Kibelka, titled "Stabilization of the Magnetic Section of Mass Spectrometers", Ser. No. 60/557,968D, filed on Mar. 31, 2004, which is incorporated herein by reference in its entirety.

In the following description, certain specific details are set forth in order to provide a thorough understanding of various embodiments of the invention. However, one skilled in the art will understand that the invention may be practiced without these details. In other instances, well-known structures associated with mass spectrometers, vacuum pumps, ion sources, silicon fabrication, transfer optics and electro static sector analyzers have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the claimed invention.

Figure 4:
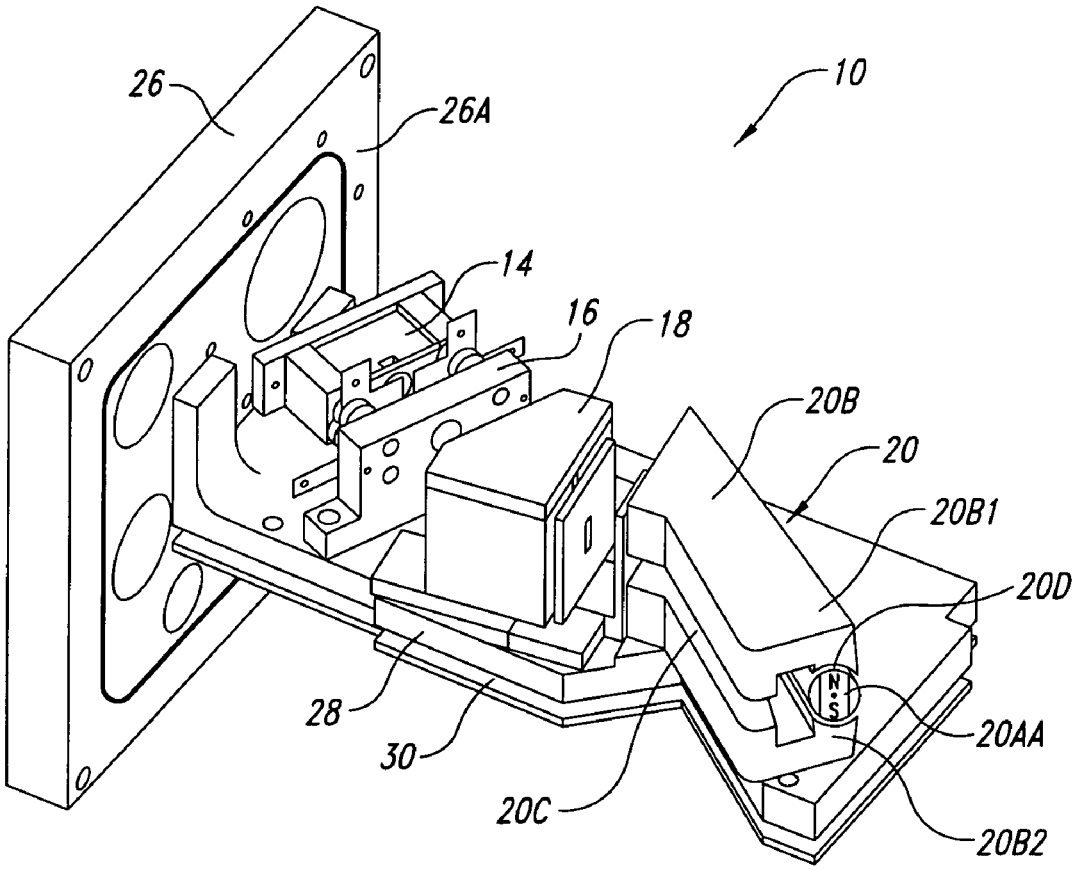
FIG. 4 illustrates a perspective view of a similar Mattauch Herzog spectrometer as in FIG. 2, including a vacuum flange, base plate, an ionizer, an electro static energy analyzer, and a switchable magnetic section according to a preferred embodiment of the instant invention. The focal plane section is not shown for purposes of clarity.

More particularly, as better illustrated in FIG. 4, this invention pertains a switchable magnetic section 20 comprising an upper yoke segment 20B1 and a lower yoke segment 20B2, opposite the upper yoke segment 20B1, collectively referred to as yoke 20B. A turnable permanent magnet segment 20AA, having a north pole N and a south pole S, is disposed between the two opposite yoke segments 20B1 and 20B2. The yoke 20B has a magnetic gap 20C, within which, ions of different masses follow different paths.

The turnable permanent magnet segment 20AA may be separated by a small magnet/yoke gap 20D, preferably less than 1 mm, and preferably of the order of 0.1 mm, or it may be substantially in contact, preferably separated by the thickness of a lubricant. Such lubricants are preferably Teflon or graphite for use inside the vacuum chamber 15 because oil cannot be used. Since it is desirable to have as high a magnetic field as possible within the magnetic gap 20C, the magnet/yoke gap 20D should be as small as possible. However, the smaller the magnet/yoke gap 20D the more difficult it becomes to turn the turnable permanent magnet segment 20AA at least for the first 90 degrees. If the magnet/yoke gap 20D approaches zero, the turning tends to become impossible, for all practical purposes. This problem is addressed and resolved by miscellaneous embodiments of this invention as described herein. Also, it is desirable, for optimal performance, that the sides of the permanent magnet are flat and coplanar with the sides of the yoke above the magnet.

In operation of this embodiment, the turnable permanent magnet segment 20AA is turned in a manner to have the north pole N and south pole S in one direction or the opposite direction with respect to the yoke segments 20B1 and 20B2. Depending on the direction, the magnetic gap 20C becomes suitable to detect positive ions or negative ions by the ion detector (not shown for purposes of clarity), which is located in front of the magnetic gap 20C.

It should be noted that depending on the polarity of the ions formed and to be detected, the components of the ionizer 14, shunt and aperture 16, and electrostatic energy analyzer 18 have to assume the appropriate potentials and polarities by techniques well known to the art.

Figure 5:
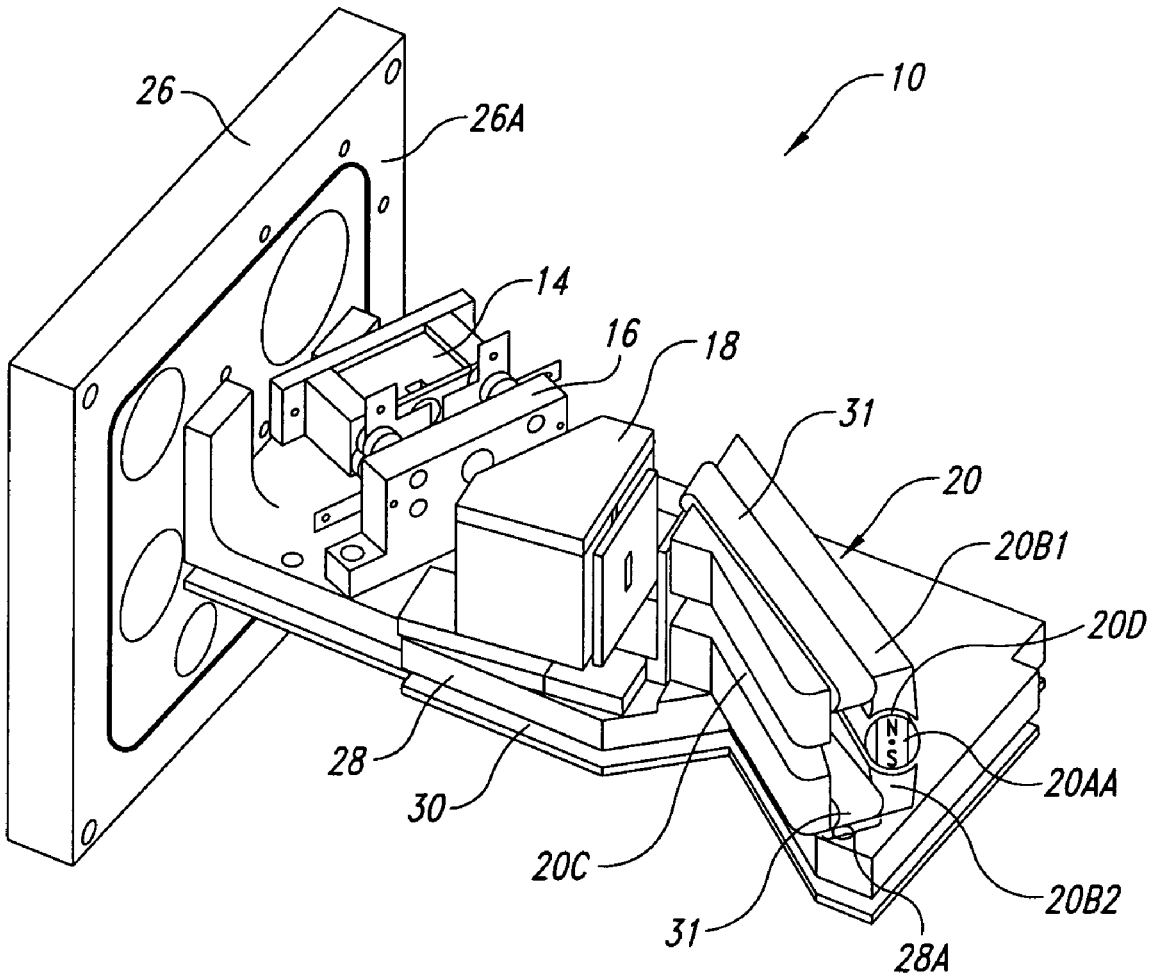
FIG. 5 illustrates a perspective view of a similar Mattauch Herzog spectrometer as in FIG. 2, including a vacuum flange, base plate, an ionizer, an electro static energy analyzer, and a switchable magnetic section along with electromagnetic coils according to another preferred embodiment of the instant invention. The focal plane section is not shown for purposes of clarity.

In a different embodiment of this invention, better illustrated in FIG. 5, the yoke further comprises coils 31. The base plate 28 has a recess 28A to accommodate one of the coils 31.

The operation of this embodiment is similar to the operation of the previous embodiment, with the difference that when it is desired to turn the turnable permanent magnet segment 20AA, the coil is activated by an electric current, by techniques well known to the art, in a manner to provide a magnetic field on the yoke of such a direction, which de-stabilizes the direction of attraction of the magnet, and causes said magnet to have a tendency to turn in an opposite direction. This helps counteract the force of the permanent magnet. By performing this operation, it is very easy to turn the magnet, and after it turns more than 90 degrees, the tendency of the turnable permanent magnet segment 20AA is to go on turning, even without the help of the electromagnetic field produced by the coils 31. Since the duration of time needed to have the coils 31 activated is at most as long as it takes to turn the turnable permanent magnet segment 20AA by 180 degrees, the energy required is minimal.

Figure 6:
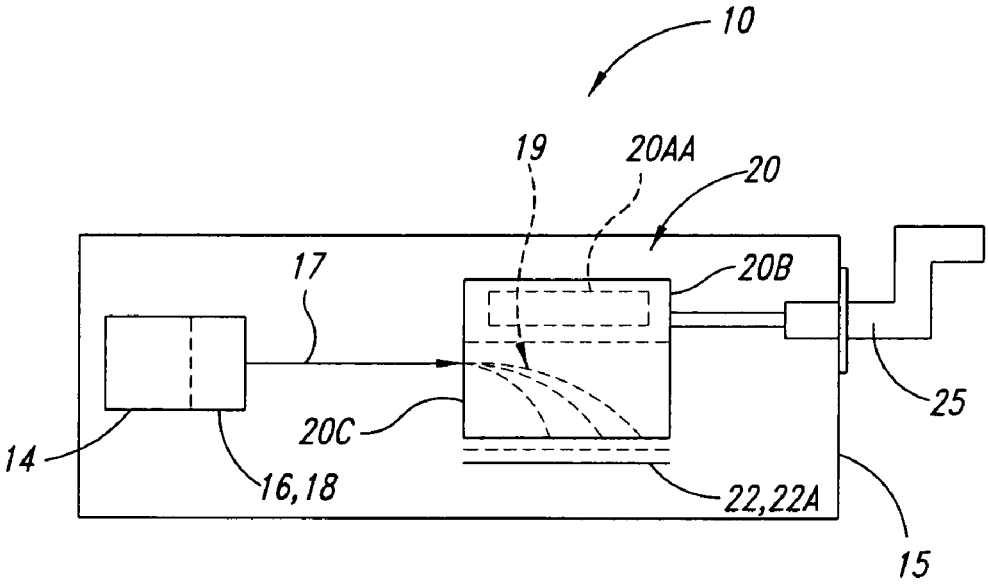
FIG. 6 is a schematic diagram of a confocal plane mass spectrometer comprising an ion source, transfer optics, electrostatic sector analyzer, magnet assembly, vacuum chamber and ion detector, where the magnet assembly is positioned in the vacuum chamber and is capable of producing a magnetic field with selectively opposing polarities within the vacuum chamber, and the ion detector is capable of detecting both negatively charged particles at one time and positively charged particles at another time.

FIG. 6 shows schematically a confocal plane or double focusing mass spectrometer 10 capable of detecting or measuring both negatively charged ions and positively charge ions. The mass spectrometer 10 includes an ion source 14, transfer optics and electro static sector analyzer 16 and 18, respectively, a vacuum chamber 15, one or more vacuum pumps (not shown) coupled to create a vacuum or near vacuum condition in the vacuum chamber 15, a magnetic section 20 capable of producing a magnetic field within the vacuum chamber 15, and an ion detector 22A at the focal plane 22. As illustrated in FIG. 6, the ions initial follow a relatively straight path 17, eventually following curved paths 19 under the influence of the magnetic field.

The ion source 14, transfer optics and electro static sector analyzer 16 and 18, respectively, and ion detector 22A at focal plane 22 are housed within the vacuum chamber 15. As illustrated in FIG. 6, the magnetic section 20 may be housed in the vacuum chamber 15.

The ion source 14 may employ electro-spray or atmospheric pressure ionization and may take the form of a spray needle, particularly where the molecules to be tested reside in an aqueous solution.

The ion detector 22A at the focal plane 22, discussed more fully below, is capable of detecting both negatively charged particles at one time and positively charged particles at another time. Typically, it is not necessary for the ion detector 22A to detect both polarities of particles at the same time. Fast switching within a run is sometimes required. For example, sometimes within 10 seconds, preferably within 1 second, and more preferably in 0.1 second. In such cases, an electromagnet, instead of a permanent magnet may be required.

Figure 7:
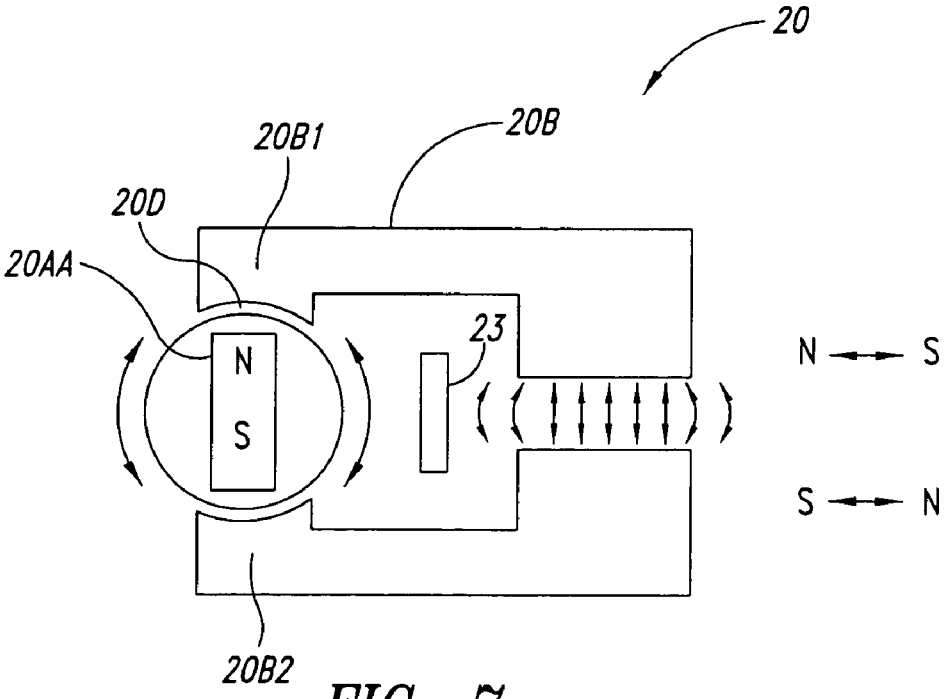
FIG. 7 is a schematic diagram of a magnet assembly suitable for mounting inside the vacuum housing.

As more fully discussed below, the magnetic section 20 may include a permanent magnet segment 20AA, a flux return or yoke 20B, and optionally a pole 23 (FIG. 7).

In operation, the magnetic section 20 is such as to allow selection of the polarity or orientation of the magnetic field in the vacuum chamber 15. Changing the polarity adjusts the flight path of the ions. Thus, negatively charged ions and positively charged ions will follow similar flight paths under opposite polarities, permitting the use of a single array of detectors at the focal plane 22

In some embodiments, such as that illustrated in FIG. 7, the magnetic section 20 includes a permanent magnet segment 20AA mounted for rotation in a flux return or yoke 20B. Simply rotating the permanent magnet segment 20AA, changes the polarity of the magnetic field in the vacuum chamber 15. FIG. 7 also shows an optional pole 23. The magnetic section 20 of FIG. 7 is particularly suitable for being located within the vacuum chamber 15, such as illustrated in FIG. 6.

With continuing reference to FIG. 7, in operation, a sufficiently long lever arm or handle 25 allows the manual rotation of the permanent magnet segment 20AA for changing the polarity of the magnetic field within the vacuum chamber 15. Alternatively, the mass spectrometer 10 may include mechanical means for rotating the permanent magnet, for example, via compressed air or other gases, an electric motor and transmission such as one or more meshed gears, solenoid, or other actuator. Use of a permanent magnet segment 20AA provides significant advantages over electromagnets, reducing system cooling load, improving calibration stability, and permitting a smaller, miniaturized system design.

Of course, the combination of the permanent magnetic segment 20AA with electromagnets 31 (FIG. 5) to reduce the turning force of the permanent magnetic segment 20AA provides enormous advantages, as aforementioned.

Figure 8:
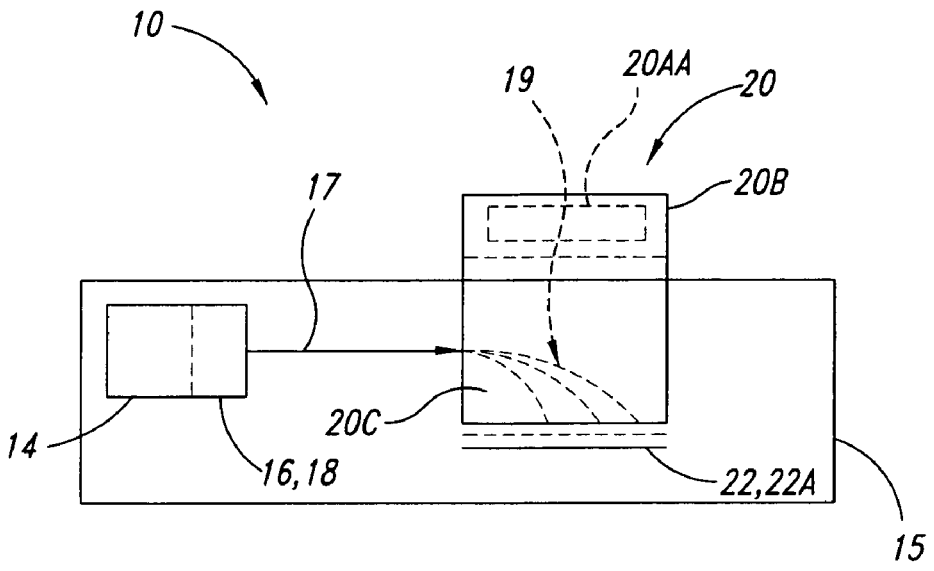
FIG. 8 is a schematic diagram of a confocal plane mass spectrometer comprising an ion source, transfer optics, electrostatic sector analyzer, magnet assembly, vacuum chamber and ion detector, where at least a portion of the magnet assembly is positioned outside of the vacuum chamber and is capable of producing a magnetic field with selectively opposing polarities within the vacuum chamber, and the ion detector is capable of detecting both negatively charged particles at one time and positively charged particles at another time.

FIG. 8 shows schematically an embodiment of the mass spectrometer 10 having the magnetic section 20 at least partially located outside of the vacuum chamber 15. Placing partially the magnetic section 20 outside of the vacuum chamber 15 provides a number of distinct benefits, particularly where the magnetic section 20 includes a rotating permanent magnet segment 20M. For example, in order to provide easy access for lubrication and to prevent out gassing events from contaminating the vacuum, which may otherwise occur in response to rotation of the permanent magnet segment 20AA. Placing the rotating permanent magnet segment 20AA outside of the vacuum chamber 15 also simplifies the structure, eliminating the need for seals on "feed throughs" into the vacuum chamber 15. As discussed above, the spectrometer 10 may employ a variety of means for rotating the permanent magnet segment 20AA to orient the magnetic field. Further, coils are preferably located outside the vacuum chamber in order to facilitate heat transfer.

Figure 9:
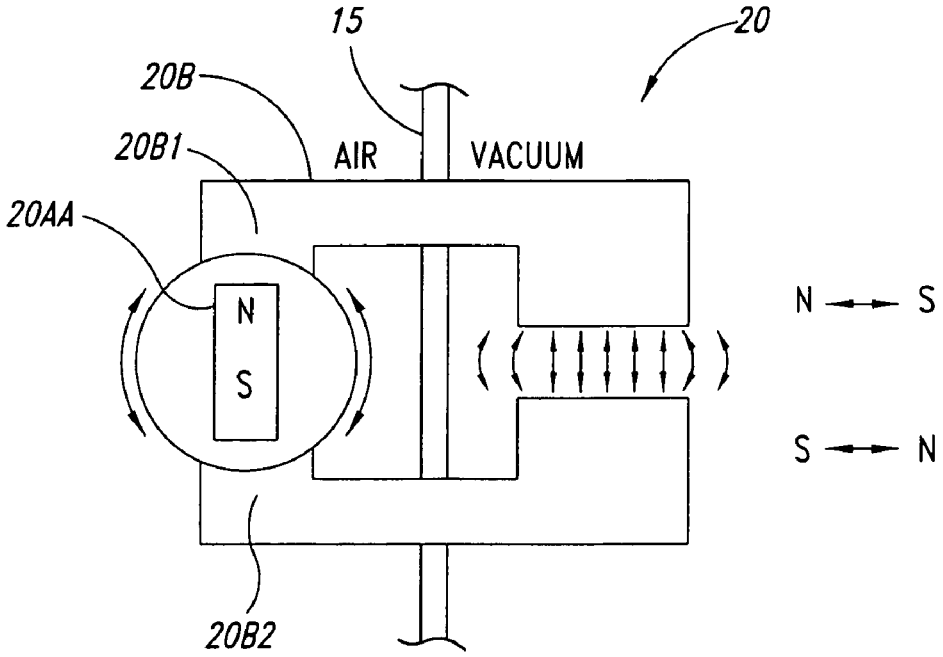
FIG. 9 is a schematic diagram of a magnet assembly comprising a permanent magnet mounted outside of the vacuum chamber and a flux return mounted at least partially within the vacuum chamber.

FIG. 9 shows an embodiment of the mass spectrometer 10, where a portion of the flux return or yoke 20B of magnetic assembly 18 is positioned within the vacuum chamber 15, and the permanent magnet 20AA of the magnetic section 20 is located outside of the vacuum chamber 15. The magnetic section 20 of FIG. 9 is particularly suitable for being partially positioned in the vacuum chamber 15, for example, as illustrated in FIG. 8. The permanent magnet segment 20AA may be mounted on a shaft or may be enclosed in a cylinder or other structure suitable for smooth, low friction rotation.

Figure 10:
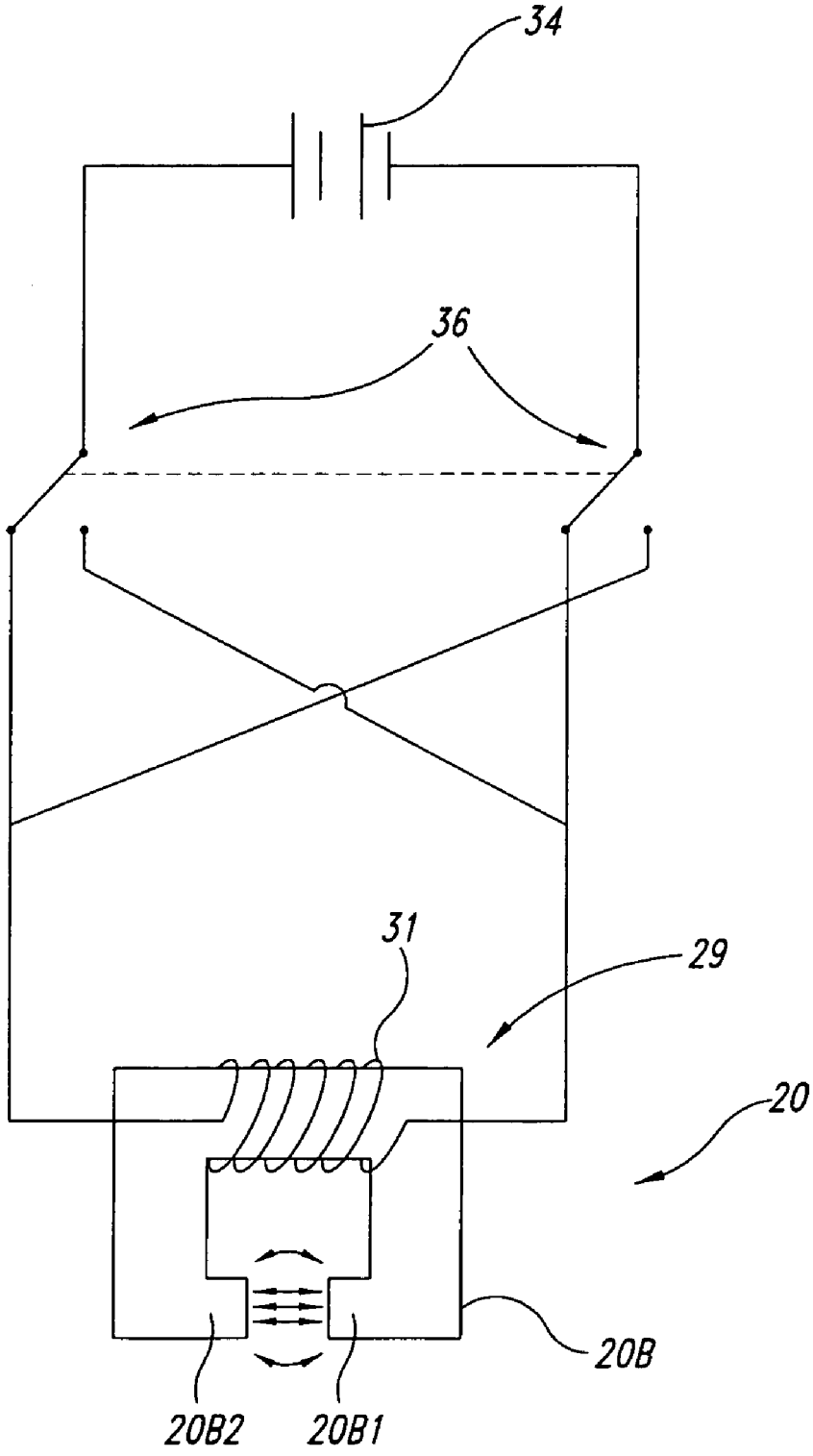
FIG. 10 is a schematic diagram of an magnet assembly employing electromagnetism.

FIG. 10 shows a magnetic section 20 employing an electromagnet 29 and flux return or yoke 20B. A coil 31 wrapped around a portion of the flux return or yoke 20B is selectively coupled to a current source 34 to produce a magnetic field. The magnetic section 20 may employ one or more switches 36 selectively operable either manually or automatically to select a direction current flow through the coil 31. Thus, the polarity of the magnetic field may be changed by simply operating the one or more switches 36 to reverse the flow of current through the coil 31.

Figure 11:
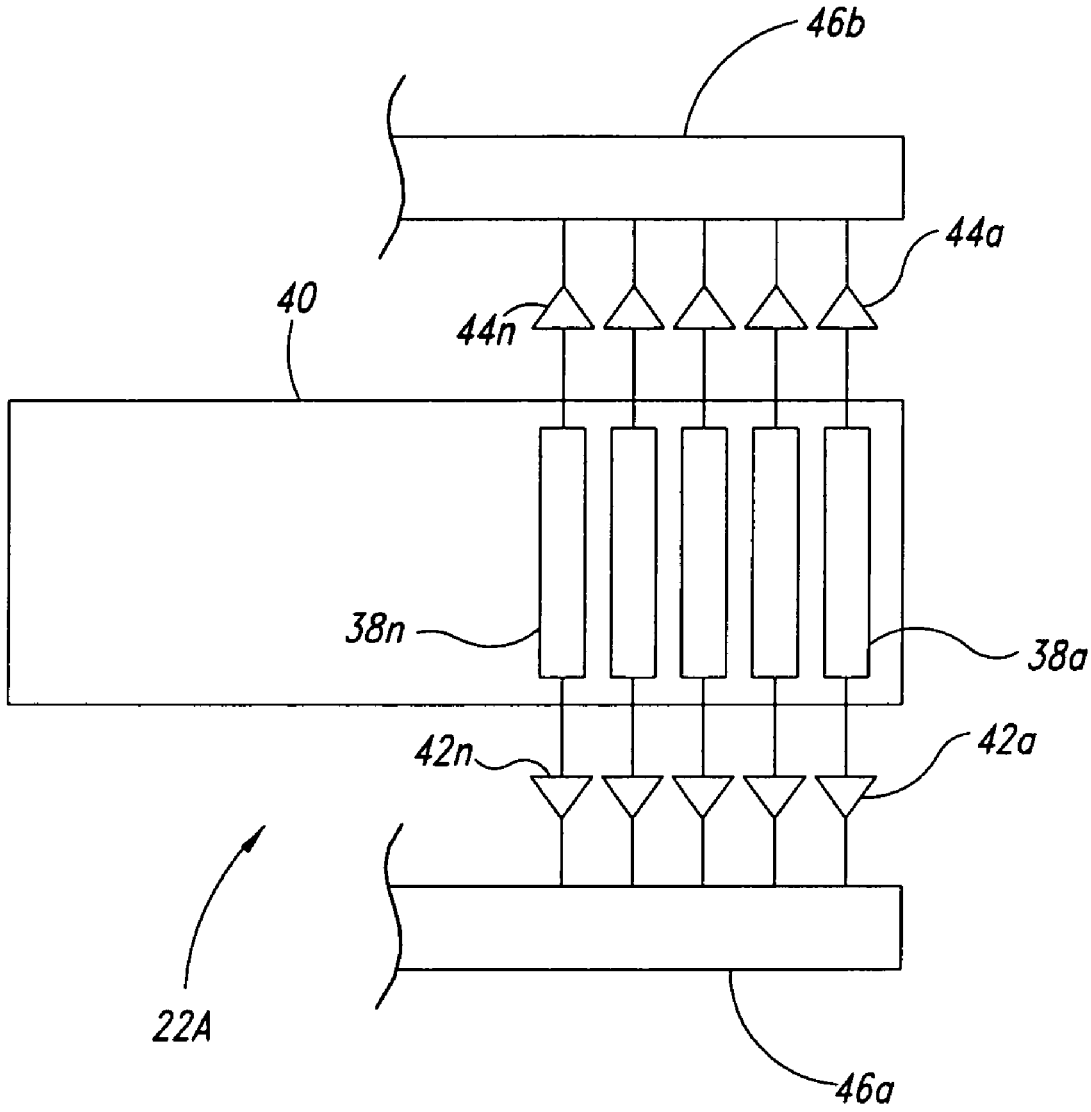
FIG. 11 is an electrical schematic diagram of an illustrated embodiment of an ion detector suitable for use with the confocal plane mass spectrometer.

FIG. 11 shows the ion detector 22A in more detail. The ion detector 22A can take a form similar to that described in U.S. Pat. No. 6,576,899, which is incorporated herein by reference. However, the ion detector described in U.S. Pat. No. 6,576,899 is only capable of measuring one type of ion, either positive or negative.

In order to measure both polarities of ions, each detector area 38*a*–38*n* on a substrate 40 (see U.S. Pat. No. 6,576,899, position 100–105–110–115) of the ion detector 22A is coupled to two charge mode amplifiers 42*a*–42*n* and 44*a*–44*n*, respectively. The first set of the charge mode amplifiers 42*a*–42*n* is coupled to first CCD shift register 46*a*, while the second set of the charge mode amplifiers 44*a*–44*n* is coupled to a second CCD shift register 46*b*.

Thus the existing CCD based ion detector 22A can be modified to detect both positive and negative ions by incorporating both n-channel and p-channel CCD technology into the design. The previous design utilizes an n-channel charge-mode amplifier, coupled to metal electrodes serving as faraday cups, for the detecting positive ions. The new embodiment makes use of a p-channel charge mode amplifier for negative ion detection. This additional structure is incorporated by the addition of n-well technology into the standard CCD process flow, and can be easily formed on a single semiconductor chip.

The negative ion channel shares the detection electrode of the positive ion detector channel, with one or the other (not both simultaneously) selected by means of a bank of enable switches, controlled by the operator or command computer. Charge readout is accomplished for the negative ion channels either by sharing the existing CCD readout structure (not shown) for the positive ions, or by incorporating a second CCD readout structure (not shown) specifically for this operation.

The above described configuration permits the selection of the polarity to be monitored.

It is evident that the magnetic field in the magnetic gap 20C (FIGS. 4 and 5) is maximized if the turnable permanent magnet segment 20AA touches the two opposite yoke segments 20B1 and 20B2. Under conventional circumstances, this would make practically impossible the turning of said permanent magnet segment 20AA, unless there is a way to separate the opposite yoke segments 20B1 and 20B2 from the permanent magnet segment 20AA during the turning process. However, such separation would require an immense force requiring excessive energy to be achieved during the process of separation.

Figure 12:
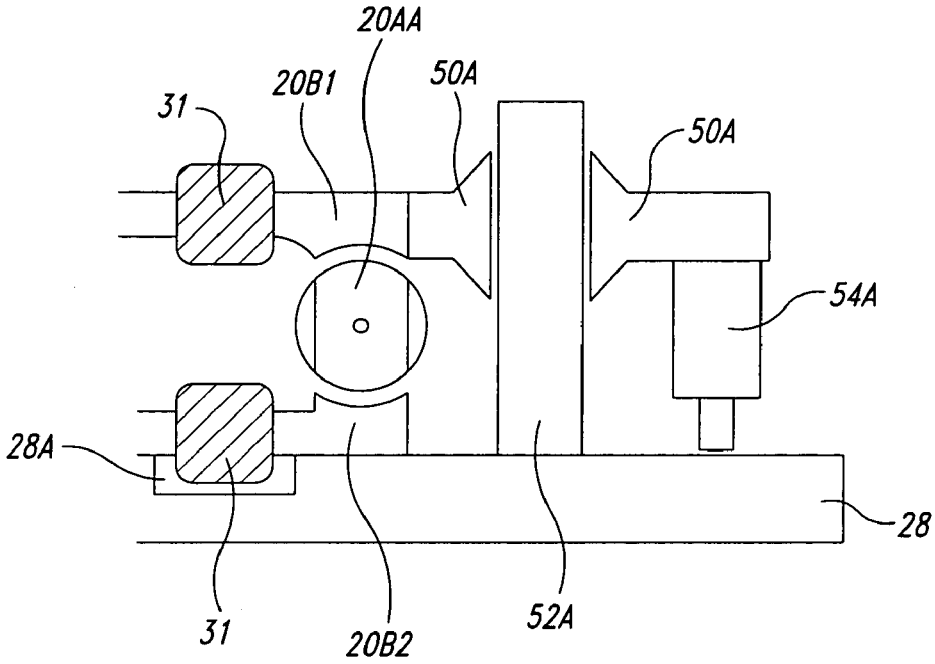
FIG. 12 is a schematic diagram of an elevation system for the upper core segment of the switchable magnetic section.
Figure 13:
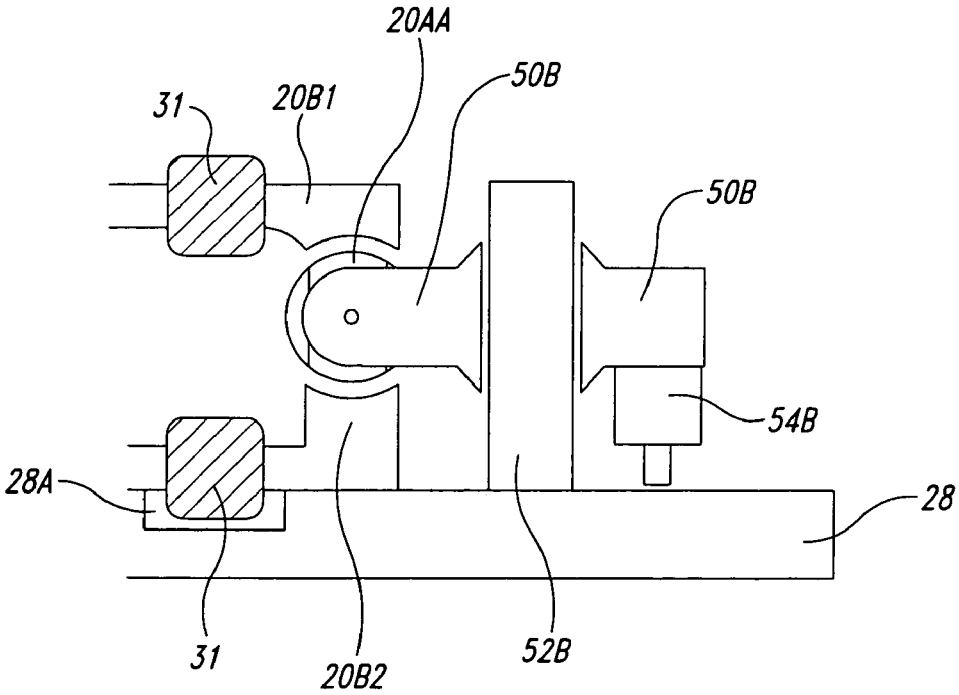
FIG. 13 is a schematic diagram of an elevation system for the permanent magnet segment of the switchable magnetic section.

This problem is resolved according to another embodiment of this invention, better illustrated in FIGS. 12 and 13. According to this embodiment, the upper yoke segment 20B1 is supported on a first slider 50A, which is operable to slide on a first column 52A by a first piston 54A.

In a similar manner as above, the turnable magnet segment 20AA is supported on a second slider 50B, which is adaptable to slide on a second column 52B by a second piston 54B.

The first and second pistons 54A and 54B, respectively, may be any type of pistons, such as for example, electromagnetic, hydraulic, pneumatic, etc.

The lower yoke segment 20B2 is preferably supported on the base plate 28.

In operation of this embodiment, initially the upper and lower yoke segments 20B1 and 20B2, are in contact with the turnable magnet segment 20AA. When it is desirable to turn the turnable magnet segment 20AA, the coils 31 are caused to provide a magnetic field of such strength, which counteracts, at least partially, the attraction of the turnable magnet segment 20AA to the upper yoke segment 20B1 and the lower magnetic segment 20B2. In sequence, the first piston 54A raises the first slider 50A (FIG. 12), which results in separating the upper yoke segment 20B1 from the turnable magnet segment 20AA. This action requires only minimal force, since, due to the counteracting magnetic field provided by the coils 31, the upper yoke segment 20B1 is not attracted strongly any more, or it may even be repelled, by the turnable magnetic segment 20AA. In sequence or at the same time, the second piston 54B raises the second slider 50B (FIG. 13), which results in separating the lower yoke segment 20B2 from the turnable magnet segment 20AA. This action also requires only minimal force, since, due to the counteracting magnetic field provided by the coils 31, the lower yoke segment 20B2 is not attracted strongly any more, or it may even be repelled, by the turnable magnetic segment 20AA.

After this separation, the turnable magnet segment 20AA is caused to easily turn substantially 180 degrees, the coils 31 are deactivated, and the pistons 54A and 54B release the respective sliders 50A and 50B, thus allowing the upper yoke segment 20B1 and the lower yoke segment 20B2 to come back in contact with the turnable magnet segment 20AA. An Hydraulic system (gas or liquid) can help prevent a slamming together effect. Also, the coils can be used in reverse with gradually decreasing power to ease closure. Of course, proper sequence of moving components up and down is required.

If so desired, the coils 31 may be activated in an opposite direction to reinforce the magnetic field in the magnetic gap 20C (FIG. 5). Also the coils may be used to compensate for magnetic field variations due to temperature variations within the magnetic gap 20C, as disclosed, for example in our co-pending provisional application No. 60/557,968, which is incorporated herein by reference.

The present invention also pertains Mass Spectrometers (MS), combination of Mass Spectrometers with other Mass Spectrometers (e.g., MS/MS), as well as combinations of Gas Chromatographs with Mass Spectrometers (e.g., GC/MS and GC/GC/MS) comprising turnable permanent magnet section of this invention. The present invention is further related to various peripherals used in combination with Mass Spectrometers including without limitation auto sampling devices and electro-spray devices.

Although the embodiments presented above are referred to Strip Charge Detector Arrays, Faraday Cup Detector Arrays, and Shift Register Based Direct Ion Detection Chips, this invention pertains any type of ion detector arrays.

Examples of embodiments demonstrating the operation of the instant invention, have now been given for illustration purposes only, and should not be construed as restricting the scope or limits of this invention in any way.

Any feature(s) described in one of the exemplary embodiments may be combined with any features incorporated in any other exemplary embodiment according to this invention.

Any explanations given are speculative and should not restrict the scope of the claims.

The same numerals in different Figures represent the same or equivalent elements or functions.

What is claimed is:

1. An instrument comprising a mass spectrometer, the mass spectrometer, comprising:

a vacuum chamber;

an ion source received in the vacuum chamber;

a magnetic assembly operable to selectively produce a magnetic field in the vacuum chamber of a first orientation at a first time, and a second orientation at a second time; and an ion detector comprising at least one detector area, at least two charge mode amplifiers coupled to the detector area, at least two CCD shift registers, a first one of the CCD shift registers coupled to a first one of the charge mode amplifiers and a second one of the CCD shift registers coupled to a second one of the charge mode amplifiers.

2. An instrument as defined in claim 1, wherein the mass spectrometer further comprises:

a set of transfer optics received in the vacuum chamber between the ion source and the ion detector; and an electro static sector analyzer received in the vacuum chamber between the ion source and the ion detector.

3. An instrument as defined in claim 1, wherein the magnetic assembly comprises a permanent magnet mounted for rotation with respect to the vacuum chamber.

4. An instrument as defined in claim 1, wherein the magnetic assembly comprises a permanent magnet and a flux return, the permanent magnet mounted for rotation with respect to the vacuum chamber.

5. An instrument as defined in claim 1, wherein the magnetic assembly comprises a permanent magnet mounted within the vacuum chamber for rotation with respect thereto.

6. An instrument as defined in claim 1, wherein the magnetic assembly comprises a permanent magnet mounted outside the vacuum chamber for rotation with respect thereto.

7. An instrument as defined in claim 1, wherein the magnetic assembly comprises a permanent magnet mounted outside the vacuum chamber for rotation with respect thereto, and a flux return at least partially mounted within the vacuum chamber.

8. An instrument as defined in claim 1, wherein the magnetic assembly comprises a coil wrapped around a flux return, a current source, and at least one switch selectively operable to cause a current to flow from the current source through the coil in a first direction at a first time and in a second direction at a second time.

* * * * *